United States Patent [19]

Trubiano

[11] 4,077,522

[45] Mar. 7, 1978

[54] ADJUSTABLE DISPLAY RACK

[76] Inventor: Antoine Trubiano, 1410 - 7th Ave., Pointe aux Trembles, Quebec, Canada

[21] Appl. No.: 723,667

[22] Filed: Sep. 15, 1976

[51] Int. Cl.[2] ..... A47F 5/13

[52] U.S. Cl. ..... 211/175; 211/181; 211/195

[58] Field of Search ..... 211/85, 106, 128, 130, 211/132, 186, 153, 175, 181, 195, 198; 312/118; 108/6, 9, 90, 99

[56] References Cited

U.S. PATENT DOCUMENTS

| | | | |
|---|---|---|---|
| 492,359 | 2/1893 | Merker | 211/181 X |
| 1,039,694 | 10/1912 | Burton | 211/106 X |
| 1,095,045 | 4/1914 | Timberlake | 211/181 UX |
| 1,751,285 | 3/1930 | Malling | 211/181 |
| 2,744,807 | 5/1956 | Bently | 211/153 X |
| 3,003,248 | 10/1961 | Wittie | 211/181 X |
| 3,385,452 | 5/1968 | Dantino et al. | 211/175 |
| 3,385,453 | 5/1968 | Dantino et al. | 211/175 |
| 3,586,411 | 6/1971 | Brigham | 211/195 X |
| 3,905,286 | 9/1975 | LeGrady | 211/181 X |

FOREIGN PATENT DOCUMENTS

| | | | |
|---|---|---|---|
| 246,432 | 2/1926 | Italy | 211/130 |
| 197,344 | 7/1965 | Sweden | 211/153 |

*Primary Examiner*—Roy D. Frazier
*Assistant Examiner*—Thomas J. Holko
*Attorney, Agent, or Firm*—Diller, Brown, Ramik & Wight

[57] ABSTRACT

An adjustable display rack for produce or the like articles. The rack comprises a base frame, a first articulated top shelf supported above the base frame and a second articulate top shelf supported above the first articulated top shelf and collapsible thereon. The first articulated top shelf has a hinge connection at a rear edge thereof. Supports are also provided to maintain the articulated top shelves in a predetermined adjustable position above the base frame.

11 Claims, 5 Drawing Figures

ADJUSTABLE DISPLAY RACK

BACKGROUND OF INVENTION a. Field of the Invention

The present invention relates to an improved collapsible display rack construction for displaying foodstuffs such as produce or the like articles in a refrigerated display counter or like display counters.

b. Description of Prior Art

It is known to support a display rack in a refrigerated counter whereby foods and vegetables or other type foodstuffs is stacked thereon to create an illusion that the display counter is filled to capacity. Such display racks are particularly useful on days where a low volume of business is done, as only a small volume of produce is placed in the counter for sale, as otherwise some of the produce would spoil. Therefore, the rack should permit the display of as few articles as possible whilst creating an appearance that the counter is filled to capacity. Racks provided to date are relatively complex in structure, difficult to adjust to various positions, require an attachment frame to secure to the counter, provide an article support surface which is fixed and therefore cannot be adjusted to support various volumes of articles while maintaining an appearance that the counter is full to capacity, and costly to produce. Another disadvantage is that many such racks are supported on boxes of fruit cases positioned in the well of the counter resulting in an unsanitary display.

SUMMARY OF INVENTION

It is a feature of this invention to provide an improved adjustable display rack which substantially overcomes all of the above-mentioned disadvantages of prior art racks.

According to the above feature, from a broad aspect, the present invention provides an adjustable display rack for foodstuff such as produce or the like articles. The rack comprises a base frame, a first articulated top shelf supported above the base frame and a second articulated top shelf supported above the first articulated top shelf and collapsible thereon. The first articulated top shelf has a hinge connection at a rear edge thereof. Supports are also provided to maintain the articulated top shelves in a predetermined adjustable position above the base frame.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
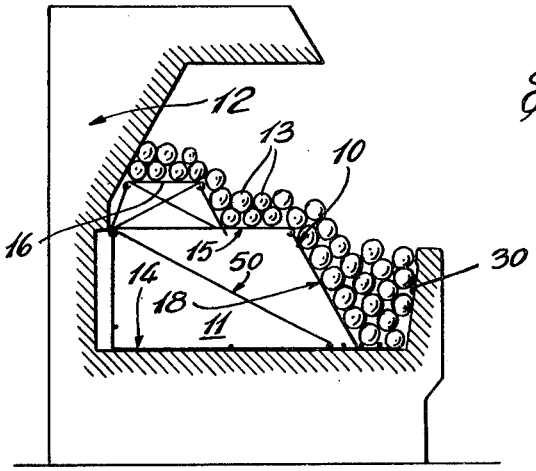
FIG. 1 is a fragmented sectional view of a refrigerated display counter utilizing the adjustable display rack of the present invention.

Referring to the drawings, and more particularly to FIG. 1, there is shown generally at 10, the adjustable display rack of the present invention positioned in the well portion 11 of a refrigerated display counter 12. The well portion 11 is ventilated with refrigerated air to maintain produce 13 supported therein fresh. The display rack 10 comprises essentially a base frame 14, a first articulated top shelf 15 is supported above the base frame 14 and a second articulated top shelf 16 supported above the first top shelf 15 and collapsible thereon. Initially, when the produce 13 is placed in the counter 12, the second articulated top shelf 16 is collapsed on the first top shelf 15 whereby more produce can be piled above the top shelf 15. As the number of produce diminishes the shelf 16 is placed in its elevated position as shown in FIG. 1 whereby to create the illusion that the well 11 of the counter 12 is filled to capacity. The refrigerated air circulating through the well maintains the produce refrigerated.

Figure 2:
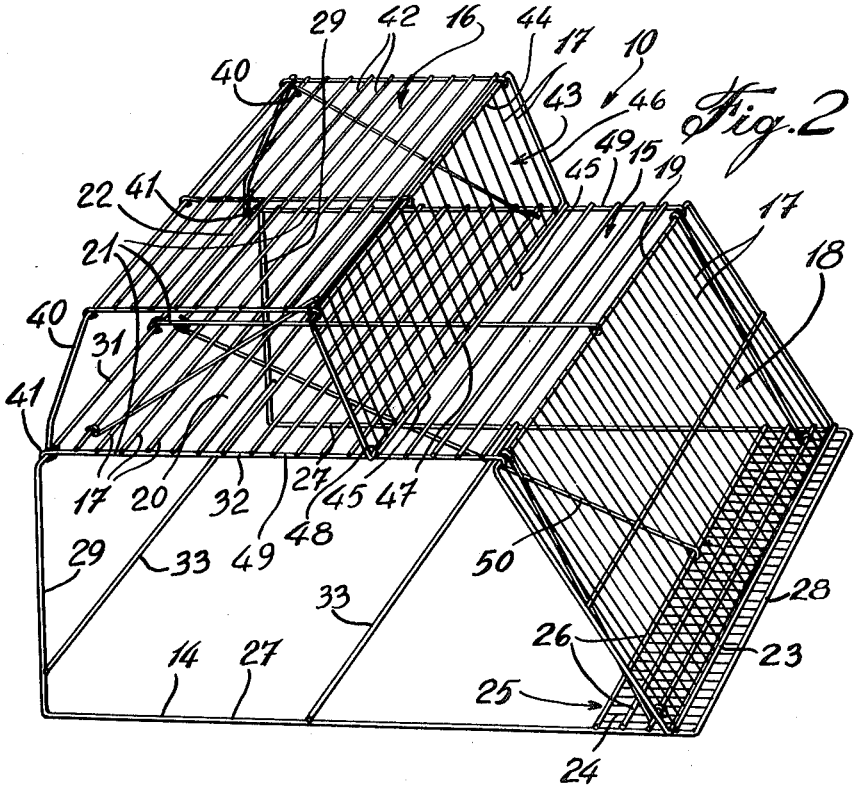
FIG. 2 is a perspective view of a display rack constructed in accordance with the preferred embodiment of the present invention.
Figure 3:
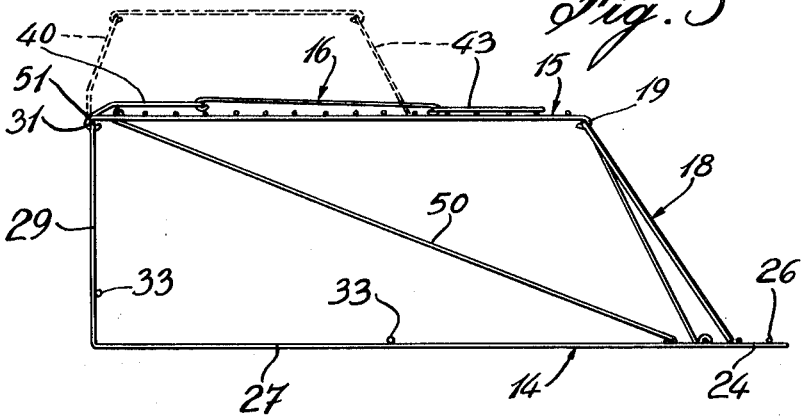
FIG. 3 is a side view of FIG. 2 showing the display rack with the second articulated top shelf collapsed on the support surface of the first articulated top shelf.

Referring now to FIG. 2, there is shown the construction of the adjustable display rack 10. The first and second articulated top shelves 15 and 16 are both constructed of wire meshing 17 as is common with display racks of this type. This meshing constitutes support surfaces 17 for both shelves 15 and 16. It can be seen that the first articulated shelf 15 is provided with a hinged front shelf section 18 which is hinged at a hinge joint 19 to the main top section 20. The hinge joint 19 extends transversely across the main top section 20. A hinge connection 21 is provided at the rear edge 22 of the main top section 20 whereby the main section 20 of the first top shelf 15 is adjustable to a desired angle. This adjustment is provided by the lower edge 23 of the hinge front shelf section 18 being selectively engageable at different locations in a front top part 24 of the base frame 14. This front part 24 constitutes an article base support shelf 25 having a plurality of rod-like members 26 extending transversely in spaced-apart relationship whereby the lower edge 23 of the front shelf 18 is positioned to abut against selected ones of the rod-like members 26 thereby adjusting the slope angle of the front shelf 18 and the slope angle of the main top section 20. It can be seen that by varying the slope of the front shelf section 18 less produce can be stored between the shelf and the front inner wall 30 of the well portion 11 of the display counter (see FIG. 1).

As shown in FIG. 2, the base frame 14 is constituted by two parallel extending spaced rod-like members 27 interconnected at a front end by a transverse integral rod-like section 28. The two rod-like members 27 are bent upwardly at a rear end to provide vertical rod-like sections 29 extending substantially transversely to the members 27 and are secured at their free ends to a transverse hinge rod member 31. The hinge connection 21 is constituted by parallel support rods 32 of the main top section 20 which are looped about the transverse hinge rod member 31 to constitute a hinge for the rear edge 22 of the top shelf 15. Transverse rods 33 are also secured between the rods 27 to constitute a rigid base frame 14.

The second articulated top shelf 16 is provided with rod-like rear arms 40 which are hinged at a lower end 41 to the transverse hinge rod member 31 and at an upper end to a main top section 42 of the second top shelf 16. These rod-like rear arms 40 are angularly formed and sloped forwardly towards the top shelf 42 to prevent obstruction with the back wall of a refrigerated display counter of the type as shown in FIG. 1. These arms 40 constitute a connection frame in the rear portion of the articulated top shelf 16.

It can be seen that the second articulated top shelf is also provided with a hinge front shelf section 43 in a front portion thereof and secured along a hinge joint 44 extending transverse to the support surface. Additionally, the front edge of the front shelf section 43 is provided with extension fingers 45 to engage between the transversely extending wire mesh 17 in the main top section 20 of the first top frame 15. The front shelf section 43 is provided with a peripheral rim 46 formed by a bent rod, and which is shaped to provide the fingers 45 and define the lower edge section 47 with shoulders 48 and at both ends thereof which rests on the transverse end rods 49 of the main top section 20 of the first top shelf 15. Thus, the front shelf section 43 is adjustable to various positions in the front part of the main top section 20.

Figure 4:
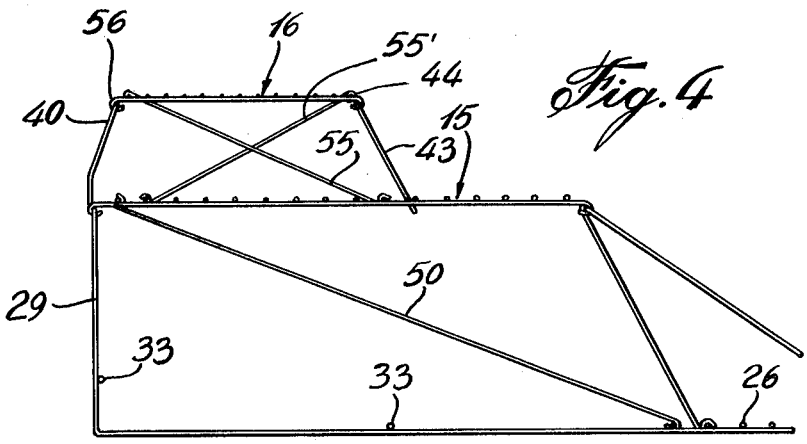
FIG. 4 is a side view illustrating various modifications of the adjustable display rack.
Figure 5:
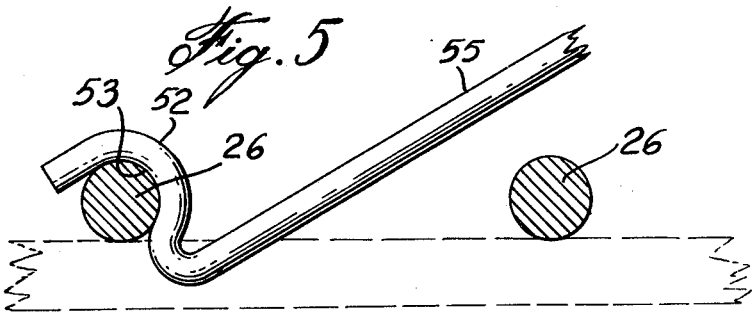
FIG. 5 is a fragmented side view of the abutment end of a support rod.

Referring to FIG. 4, there is shown a variation of the construction of the display rack whereby the support means for the shelves is provided additionally or solely by support rods. As shown in FIG. 4, one or more support rods 50 may be hinged to the transverse hinge rod member 31 at a hinge connection end 51 thereof. The other end constitutes an abutment end 52, as shown in FIG. 5, which defines an abutment recess 53 for support on one of the transverse rods 26 provided across the shelf 24 of the base frame 14.

The second articulated to shelf 15 may be provided with similar support rods and as shown in FIG. 4, there are two such rods 55 and 55'. Rod 55 is hinged adjacent a rear edge 56 of the support surface 42 of the second articulated top shelf. The other rod 55' is hinged at the hinged joint 44 of the front shelf section 43. Each of the two rods 55 and 55' are connected on a respective side of the second articulated top shelf 16. The rods extend in opposite directions and each is provided with an abutment end engageable in the transverse wire mesh of the support surface 17 on the main top section 20 of the first articulated top shelf 16. These support rods 50, 55 and 55' are provided to give more rigidity to each of the articulated top shelves.

It is within the ambit of the present invention to incorporate herein any obvious modifications of the embodiment disclosed, provided such modifications fall within the scope of the broadest claim, as appended herewith.

I claim:

1. An adjustable display rack for foodstuff such as produce or the like articles comprising a base frame, a first articulated top shelf supported above said base frame, said first articulated top shelf having a hinged connection at a rear edge thereof and a hinged front shelf section with a hinge joint extending across an article support surface of said first articulated top shelf, support means to maintain said articulated top shelf in a predetermined adjustable position above said base frame, and a second articulated top shelf supported above said first articulated top shelf and collapsible on said first articulated top shelf behind its front shelf section in a substantially flat condition whereby articles may be positioned over the collapsed second articulated top shelf, said second articulated top shelf having an article support surface and a hinged front shelf section with a hinge joint extending across its article support surface, a connecting frame in a rear portion of said second articulated top shelf, said connecting frame being angularly formed and having a bottom hinge connection secured on an axis common with said hinge connection at said rear edge of said first articulated top shelf, and means to maintain said second articulated top shelf in a fixed elevated position above said first articulated top shelf.

2. A display rack as claimed in claim 1 wherein said hinged front shelf section of said second articulated top shelf is provided with one or more extension fingers extending beyond a front edge thereof and engageable in said article support surface of said first articulated top shelf.

3. A display rack as claimed in claim 1 wherein said means to maintain said second articulated top shelf in a fixed elevated position comprises one or more support rods, each said rods having a hinge connection end and an abutment end, said ends being securable between said first and second articulated top shelves.

4. A display rack as claimed in claim 3 wherein said hinge connection end is secured to said second articulated top shelf, said abutment end defining an abutment recess for support on a rod-like member of a plurality of rod-like members extending over said rear portions of said support surface of said first articulated top shelf below said second articulated top shelf.

5. A display rack as claimed in claim 4 wherein there are two of said support rods, one of said two support rods being hinged adjacent a rear edge of said rear portion of said second articulated top shelf, the other of said two support rods being hinged adjacent said hinge joint of said front shelf section, each of said two support rods being connected on a respective side of said second articulated top shelf with said rods extending in opposite directions under said second articulated top shelf.

6. A display rack as claimed in claim 1 wherein said support means is constituted by the lower edge of said hinged front shelf section being selectively engageable in a front part of said base frame.

7. A display rack as claimed in claim 6 wherein said base frame is provided with an article base support shelf in said front part thereof, one or more rod-like members extending transversely across said base support shelf to form a support surface, said lower edge of said front shelf section abutting against a selected one of said one or more rod-like members.

8. A display rack as claimed in claim 1 wherein said support means is constituted by one or more support posts, each of said posts having a hinge connection end and an abutment end, one of said ends being secured to said base frame and the other end being secured to said first articulated top shelf rearwardly of said hinge joint.

9. A display rack as claimed in claim 8 wherein there are two of said support posts, each of said two support posts being hinged at said hinge joint adjacent a respective side edge of said first articulated top shelf, the other end of said two posts having an abutment end for support in a front part of said base frame.

10. A display rack as claimed in claim 9 wherein said base frame is provided with an article base support shelf in said front part thereof, one or more rod-like members extending transversely across said base support shelf, said abutment end of said support posts resting on one of said one or more rod-like members.

11. An adjustable display rack for foodstuff such as produce or the like articles comprising a base frame, a first articulated top shelf supported above said base frame, said first articulated top shelf having a hinged connection at a rear edge thereof and a hinged front shelf section with a hinge joint extending across an article support surface of said first articulated top shelf, support means to maintain said articulated top shelf in a predetermined adjustable position above said base frame, and a second articulated top shelf supported above said first articulated top shelf and collapsible on said first articulated top shelf behind its front shelf section in a substantially flat condition whereby articles may be positioned over the collapsed second articulated top shelf, said second articulated top shelf having an article support surface and a hinged front shelf section with a hinge joint extending across its article support surface, a connecting frame in a rear portion of said second articulated top shelf, and means to maintain said second articulated top shelf in a fixed elevated position above said first articulated top shelf, said base frame having at least two parallel extending spaced-apart rod-like members interconnected at a front end by a transverse integral rod-like section, said two rod-like members being bent upwardly at a rear end and extending to a free end, a transverse hinge rod member secured between said free end of said two rod-like members, said rear edge of said first articulated top shelf being hinged to said transverse hinge rod member, and said second articulated top shelf further being hinged along a rear edge thereof to said transverse hinge rod member.

* * * * *